US012134948B2

(12) United States Patent
Guidry et al.

(10) Patent No.: US 12,134,948 B2
(45) Date of Patent: Nov. 5, 2024

(54) HANGER SYSTEMS AND METHODS

(71) Applicant: Cameron International Corporation, Houston, TX (US)

(72) Inventors: Kirk Guidry, Cypress, TX (US); Dennis P. Nguyen, Pearland, TX (US); Barret Heinrich, Houston, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 18/264,941

(22) PCT Filed: Feb. 15, 2022

(86) PCT No.: PCT/US2022/016450
§ 371 (c)(1),
(2) Date: Aug. 10, 2023

(87) PCT Pub. No.: WO2022/177899
PCT Pub. Date: Aug. 25, 2022

(65) Prior Publication Data

US 2024/0125194 A1 Apr. 18, 2024

Related U.S. Application Data

(60) Provisional application No. 63/150,010, filed on Feb. 16, 2021.

(51) Int. Cl.

| | |
|---|---|
| ***E21B 47/095*** | (2012.01) |
| ***E21B 19/24*** | (2006.01) |
| ***E21B 33/04*** | (2006.01) |

(52) U.S. Cl.
CPC ..... *E21B 33/0422* (2013.01); *E21B 19/24* (2013.01); *E21B 47/095* (2020.05)

(58) Field of Classification Search
CPC .... E21B 33/0422; E21B 47/095; E21B 19/24; E21B 33/04
See application file for complete search history.

(56) References Cited

U.S. PATENT DOCUMENTS

| | | | |
|---|---|---|---|
| 2,094,812 | A | 10/1937 | Penick et al. |
| 4,832,125 | A | 5/1989 | Taylor |
| 5,307,879 | A | 5/1994 | Kent |

(Continued)

FOREIGN PATENT DOCUMENTS

| | | | |
|---|---|---|---|
| EP | 0320135 | A1 | 6/1989 |
| WO | 2015187279 | A1 | 12/2015 |

OTHER PUBLICATIONS

Office Action issued in U.S. Appl. No. 17/651,276 dated Dec. 20, 2023, 12 pages.

(Continued)

*Primary Examiner* — Shane Bomar
(74) *Attorney, Agent, or Firm* — Jeffrey D. Frantz

(57) ABSTRACT

A system includes a hanger with a radially-outer surface with a hanger surface texture. The system also includes a sensor configured to detect vibrations induced by the hanger surface texture as the hanger moves through a housing of a wellhead. The system further includes a controller configured to receive signals indicative of the vibrations from the sensor and to process the signals to determine a position of the hanger within the housing of the wellhead.

15 Claims, 6 Drawing Sheets

(56) References Cited

U.S. PATENT DOCUMENTS

| | | | | |
|---|---|---|---|---|
| 5,735,344 | A | 4/1998 | Duncan | |
| 6,662,868 | B1 | 12/2003 | Van Bilderbeek | |
| 2002/0189806 | A1* | 12/2002 | Davidson | E21B 41/0014 166/336 |
| 2004/0104024 | A1 | 6/2004 | Kent et al. | |
| 2006/0131018 | A1* | 6/2006 | Rogers | E21B 33/05 166/285 |
| 2007/0039738 | A1* | 2/2007 | Fenton | E21B 47/09 166/368 |
| 2010/0126736 | A1 | 5/2010 | Ellis et al. | |
| 2011/0203810 | A1 | 8/2011 | Nguyen | |
| 2011/0284206 | A1 | 11/2011 | Nguyen | |
| 2013/0020095 | A1 | 1/2013 | Vanderford et al. | |
| 2013/0220637 | A1* | 8/2013 | Fabela | E21B 31/18 166/382 |
| 2016/0138373 | A1* | 5/2016 | Wood | E21B 43/105 166/250.01 |
| 2016/0290094 | A1 | 10/2016 | Nguyen | |
| 2016/0319657 | A1 | 11/2016 | Szpunar et al. | |
| 2017/0191335 | A1 | 7/2017 | Nguyen et al. | |
| 2017/0362910 | A1* | 12/2017 | Stephens | E21B 33/143 |
| 2018/0163491 | A1 | 6/2018 | Nguyen et al. | |
| 2018/0163520 | A1 | 6/2018 | Navar et al. | |
| 2018/0179829 | A1 | 6/2018 | Nguyen | |
| 2018/0179881 | A1* | 6/2018 | Thompson | G01V 11/002 |
| 2019/0078397 | A1 | 3/2019 | Nguyen | |
| 2019/0169980 | A1* | 6/2019 | Gilleland | E21B 33/04 |
| 2021/0070104 | A1 | 3/2021 | Tsuji | |
| 2022/0259938 | A1 | 8/2022 | Guidry | |
| 2022/0268110 | A1* | 8/2022 | Painter | E21B 33/14 |

OTHER PUBLICATIONS

Notice of Allowance issued in U.S. Appl. No. 17/651,276 dated Feb. 16, 2022, 8 pages.

International Search Report and Written Opinion issued in PCT/US2022/016450, dated Jun. 2, 2022 (11 pages).

* cited by examiner

HANGER SYSTEMS AND METHODS

CROSS-REFERENCE TO RELATED APPLICATION

This application is the National Stage Entry of International Application No. PCT/US2022/016450, filed Feb. 15, 2022, which claims priority to and the benefit of U.S. Provisional Application No. 63/150,010, entitled "HANGER SYSTEMS AND METHODS" and filed Feb. 16, 2021, which is incorporated by reference herein in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity. Once a desired natural resource is discovered below the surface of the earth, mineral extraction systems are often employed to access and extract the desired natural resource. The mineral extraction systems may be located onshore or offshore depending on the location of the desired natural resource. The mineral extraction systems generally include a wellhead through which the desired natural resource is extracted. The wellhead may include or be coupled to a wide variety of components, such as a tubing hanger that supports a tubing, a casing hanger that supports a casing, valves, fluid conduits, and the like.

SUMMARY

In one embodiment, a system includes a hanger with a radially-outer surface with a hanger surface texture. The system also includes a sensor configured to detect vibrations induced by the hanger surface texture as the hanger moves through a housing of a wellhead. The system further includes a controller configured to receive signals indicative of the vibrations from the sensor and to process the signals to determine a position of the hanger within the housing of the wellhead.

In one embodiment, a system includes a hanger configured to move in an axial direction within a housing of a wellhead, wherein the hanger has a radially-outer surface with a hanger surface texture. The system also includes a sensor configured to generate signals indicative of axial alignment of the hanger surface texture with a clamp coupled to the housing of the wellhead. The system further includes a controller configured to receive the signals, analyze the signals to identify the axial alignment, and provide an output in response to identifying the axial alignment.

In one embodiment, a method includes running, with a hanger running tool, a hanger into a housing of a wellhead, wherein the hanger has a radially-outer surface with a hanger surface texture. The method also includes detecting, with a sensor, vibrations induced by contact between the hanger surface texture and the housing of the wellhead as the hanger moves through the housing of the wellhead. The method further includes processing, at a controller, signals generated by the sensor to determine a position of the hanger within the housing of the wellhead.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating conditions and/or environmental conditions do not exclude other conditions.

Certain embodiments of the present disclosure generally relate to a hanger system that is configured to be positioned within a wellhead. The hanger system may include a tubing hanger that supports a tubing (e.g., tubing string) and/or a casing hanger that supports a casing (e.g., casing string). The hanger system may utilize a seal system that includes one or more surfaces with a surface texture (e.g., surface feature, surface profile, POS-GRIP®. For example, a radially-outer annular surface of the tubing hanger may include the surface texture. As another example, the radially-outer annular surface of the tubing hanger and the radially-inner annular surface of the housing of the wellhead may include complementary surface textures. In any case, the one or more surface textures may form a seal (e.g., annular seal) when the radially-outer annular surface of the tubing hanger and the radially-inner annular surface of the housing of the wellhead are brought together (e.g., via radial compression with one or more clamps).

Figure 1:
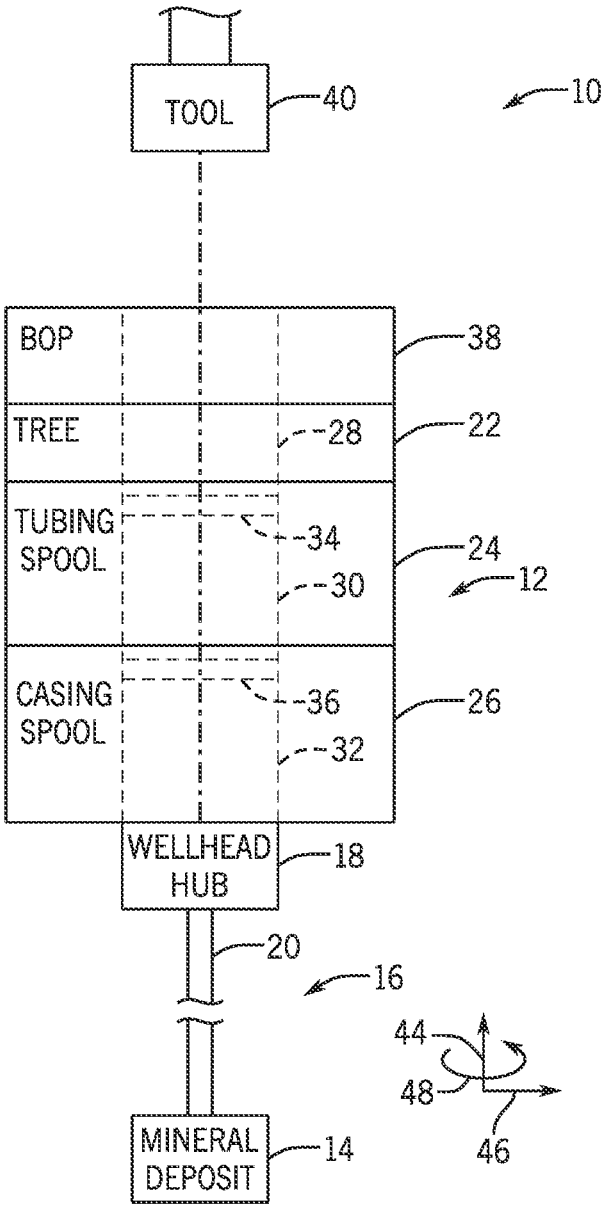
FIG. 1 is a block diagram of a mineral extraction system, in accordance with an embodiment of the present disclosure.

FIG. 1 is a block diagram of an embodiment of a mineral extraction system 10. The mineral extraction system 10 may be utilized to extract various natural resources (e.g., hydrocarbons, such as oil and/or natural gas) from the earth. As illustrated, the mineral extraction system 10 includes a wellhead 12 coupled to a mineral deposit 14 via a well 16. The well 16 may include a wellhead hub 18 and a wellbore 20. The wellhead hub 18 generally includes a large diameter hub disposed at an end of the wellbore 20 and is configured to connect the wellhead 12 to the wellbore 20. As will be appreciated, the wellbore 20 may contain elevated pressures. For example, the wellbore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16.

In the illustrated embodiment, the mineral extraction system 10 includes a tree 22, a tubing spool 24, a casing spool 26, and a blowout preventer (BOP) 38. The tree 22 generally includes a variety of flow paths (e.g., bores), valves, fittings, and controls for operating the well 16. Further, the tree 22 may provide fluid communication with the well 16. For example, the tree 22 includes a tree bore 28 that provides for completion and workover procedures, such as the insertion of tools into the well 16, the injection of various chemicals into the well 16, and so forth. Further, the natural resources extracted from the well 16 may be regulated and routed via the tree 22. For example, the tree 22 may be coupled to a flowline that is tied back to other components, such as a manifold.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the wellbore 20 for various completion and workover procedures. The BOP 38 may consist of a variety of valves, fittings, and controls to block oil, gas, and/or other fluid from exiting the well 16 in the event of an unintentional release of pressure or an overpressure condition.

As shown, a tubing hanger 34 is positioned within the tubing spool 24. The tubing hanger 34 may be configured to support tubing (e.g., a tubing string) that is suspended in the wellbore 20 and/or to provide a path for control lines, hydraulic control fluid, chemical injections, and so forth. Additionally, as shown, a casing hanger 36 is positioned within the casing spool 26. The casing hanger 36 may be configured to support casing (e.g., a casing string) that is suspended in the wellbore 20. A seal system may provide a seal (e.g., annular seal) between the tubing hanger 34 and the tubing spool 24 and/or a seal (e.g., annular seal) between the casing hanger 36 and the casing spool 26. One or more tools 40 may be used to run the tubing hanger 34 and the casing hanger 36 into the tubing spool bore 30 and the casing spool bore 32, respectively. To facilitate discussion, the mineral extraction system 10, and the components therein, may be described with reference to an axial axis or direction 44, a radial axis or direction 46, and a circumferential axis or direction 48.

Figure 2:
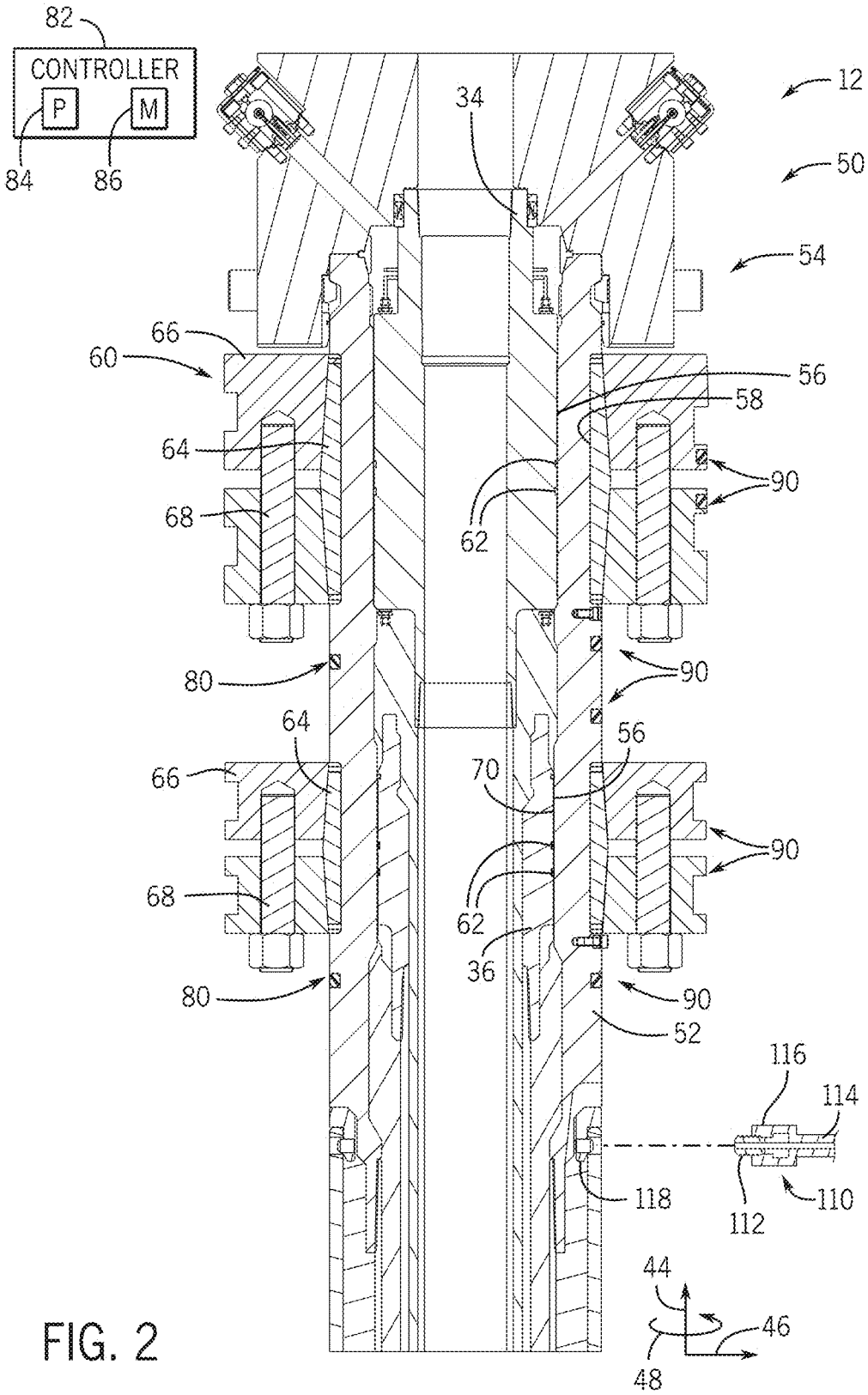
FIG. 2 is a cross-sectional side view of a hanger system that may be utilized within a wellhead of the mineral extraction system of FIG. 1, in accordance with an embodiment of the present disclosure.

FIG. 2 is a cross-sectional side view of an embodiment of a hanger system 50 that may be utilized within the wellhead 12 of the mineral extraction system 10 of FIG. 1. As shown, the wellhead 12 includes a housing 52 (e.g., annular housing, including the tubing spool 24 and the casing spool 26 of FIG. 1), and the hanger system 50 may include the tubing hanger 34 within the housing 52. The hanger system 50 may also include a seal system 54 that includes one or more surfaces with a surface texture (e.g., surface feature, surface profile, POS-GRIP®. In some embodiments, a tubing hanger surface texture may be provided on a radially-outer annular surface 58 of the tubing hanger 34 to facilitate engagement and/or sealing with a radially-inner annular surface 56 of the housing 52. In some embodiments, the tubing hanger surface texture may be provided on the radially-outer annular surface 58 of the tubing hanger 34, and a first housing surface texture may be provided on the radially-inner annular surface 56 of the housing 52 to facilitate engagement and/or sealing between the surfaces 56, 58.

The tubing hanger surface texture may extend about all or a portion of a circumference of the radially-outer annular surface 58 of the tubing hanger 34, and the first housing surface texture may extend about all or a portion of a circumference of the radially-inner annular surface 56 of the housing 52. When both the tubing hanger surface texture and the first housing surface texture are present, the tubing hanger surface texture and the first housing surface texture may be the same or different (e.g., with respect to characteristics, such as shape, spacing [along the axial axis 44], density [number of teeth or protrusions per surface area unit], and/or height or degree of protrusion from the surfaces 56, 58). Additionally, when both the tubing hanger surface texture and the first housing surface texture are present, the tubing hanger surface texture and the first housing surface texture may have corresponding or complementary profiles that facilitate formation of a friction fit to provide support, the engagement, and/or the seal. For example, the tubing hanger surface texture and the first housing surface texture may each include teeth, wherein the teeth of the tubing hanger surface texture are offset along the axial axis 44 from the teeth of the first housing surface texture in order to overlap along the radial axis 46 and/or interlock with one another (e.g., upon being driven toward one another) to facilitate formation of the friction fit to provide the engagement and/or the seal. However, it should be appreciated that opposed surface textures (e.g., teeth) may be aligned and not offset along the axial axis 44. Furthermore, as noted herein, there may not be opposed surface textures (e.g., only one of the radially-outer annular surface 58 of the tubing hanger 34 or the radially-inner annular surface 56 of the housing 52 may have the surface texture, and the other surface may be devoid of the surface texture/smooth).

The seal system 54 may also include a compression system 60 (e.g., clamp system) that includes a first clamp that is configured to drive the housing 52 radially-inwardly toward the tubing hanger 34 to cause the tubing hanger surface texture on the radially-outer annular surface 58 of the tubing hanger 34 to engage the radially-inner annular surface 56 of the housing 52, which may include the first housing surface texture, to form a seal (e.g., annular seal) between the tubing hanger 34 and the housing 52. The seal may be a metal-to-metal seal, and the seal may be supplemented with one or more non-metal supplemental seals 62 (e.g., annular elastomer seals, such as o-ring seals; zero-gap extrusions). In some cases, the surface texture(s) and/or the one or more non-metal seals may contact the radially-inner surface 56 of the housing 52 to form a zero-gap configuration (e.g., contact with the housing 52) prior to actuation of the compressions system 60.

The compression system 60 may have any suitable form that enables compression at an interface between the housing 52 and the tubing hanger 34. For example, as shown, the compression system 60 may include the first clamp that has a wedge structure 64, a flange 66, and one or more fasteners 68. The wedge structure 64 may be an annular wedge structure or a ring that has radially-outer surfaces that taper from a center line or portion to outer edges or portions (e.g., a width along the radial axis 46 at the center line or portion is greater than respective widths along the radial axis 46 at the outer edges or portions). The flange 66 may be an annular flange that includes two annular rings stacked along the axial axis 44 (e.g., stacked and spaced apart along the axial axis 44 at least in some configurations) and that receive the one or more fasteners 68. The one or more fasteners 68 may be spaced apart along the circumferential axis 48 and are configured to rotate to tighten/cause one or both of the annular rings of the flange 66 to move to be closer together along the axial axis 44. Thus, one or both of the annular rings of the flange 66 slide along the wedge structure 64 (e.g., along tapered surfaces of the wedge structure 64) to drive the wedge structure 64 and the housing 52 to move along the radial axis 46 toward the tubing hanger 34.

As shown, the hanger system 50 may also include the casing hanger 36 within the housing 52. In some embodiments, the seal system 54 may include a casing hanger surface texture on a radially-outer annular surface 70 of the casing hanger 36 to facilitate engagement and/or sealing with the radially-inner annular surface 56 of the housing 52. In some embodiments, the casing hanger surface texture may be provided on the radially-outer annular surface 70 of the casing hanger 36, and a second housing surface texture may be provided on the radially-inner annular surface 56 of the housing 52 to facilitate engagement and/or sealing between the surfaces 56, 70.

The casing hanger surface texture may extend about all or a portion of a circumference of the radially-outer annular surface 70 of the casing hanger 36, and the second housing surface texture may extend about all or a portion of a circumference of the radially-inner annular surface 56 of the housing 52. When both the casing hanger surface texture and the second housing surface texture are present, the casing hanger surface texture and the second housing surface texture may be the same or different (e.g., with respect to characteristics, such as shape, spacing, density, and/or height or degree of protrusion from the surfaces 56, 58). Additionally, when both the casing hanger surface texture and the second housing surface texture are present, the tubing hanger surface texture and the second housing surface texture may have corresponding or complementary profiles that facilitate formation of a friction fit to provide the engagement and/or the seal. For example, the casing hanger surface texture and the second housing surface texture may each include teeth, wherein the teeth of the casing hanger surface texture are offset along the axial axis 44 from the teeth of the second housing surface texture in order to overlap along the radial axis 46 and/or interlock with one another (e.g., upon being driven toward one another) to facilitate formation of the friction fit to provide the engagement and/or the seal. However, it should be appreciated that opposed surface textures (e.g., teeth) may be aligned and not offset along the axial axis 44.

The compression system 60 may include a second clamp that is configured to drive the housing 52 radially-inwardly toward the casing hanger 36 to cause the casing hanger surface texture on the radially-outer annular surface 70 of the casing hanger 36 to engage the radially-inner annular surface 56 of the housing 52, which may include the second housing surface texture, to form a seal (e.g., annular seal) between the casing hanger 36 and the housing 52. The seal may be a metal-to-metal seal, and the seal may be supplemented with one or more non-metal supplemental seals 62 (e.g., annular elastomer seals, such as o-ring seals). The compression system 60 may have any suitable form that enables compression of the housing 52 toward the casing hanger 36. For example, as shown, the compression system 60 may include the second clamp that has the wedge structure 64, the flange 66, and the one or more fasteners 68 that operate in a similar manner as the first clamp.

As noted herein, any of the surface textures present in the hanger system 50 (e.g., on the tubing hanger 34, the casing hanger 36, and/or the housing 52) may be the same or different (e.g., with respect to characteristics). Additionally or alternatively, any of the surface textures may be uniform or non-uniform (e.g., one portion of the tubing hanger surface texture may have certain characteristics, and another portion of the tubing hanger surface texture may have other characteristics). Additionally or alternatively, the surface textures may vary based on a size (e.g., inner diameter) of the housing 52, features (e.g., size, such as outer diameter and/or weight) of the respective hanger (e.g., the tubing hanger 34, the casing hanger 36), and/or conditions (e.g., expected operating conditions and/or environmental conditions) at the wellhead 12. For example, a set of tubing hangers may include tubing hangers of different sizes. In such cases, for one tubing hanger with a first, smaller inner diameter, the tubing hanger surface texture may have certain characteristics (e.g., a first density). However, for another tubing hanger with a second, larger inner diameter, the tubing hanger surface texture may have certain characteristics (e.g., a second density less than the first density). Similar variations may apply to a set of casing hangers of different sizes.

Certain examples herein include the surface texture (e.g., the tubing hanger surface texture, the casing hanger surface texture) on the radially-outer annular surface of the hanger (e.g., the tubing hanger, the casing hanger). In some such cases, the radially-inner annular surface of the housing 52 may be devoid of the surface texture (e.g., may be smooth, such as without radially-inwardly extending teeth and/or relatively smooth compared to the radially-outer annular surface of the hanger that is configured to engage and/or seal against the radially-inner annular surface of the housing 52). However, it should be appreciated that the surface texture may be provided on both the radially-outer annular surface of the hanger and on the radially-inner surface of the housing 52. As noted herein, when such opposed or mating surface textures (e.g., the first housing surface texture and the tubing hanger surface texture; the second housing surface texture and the casing hanger surface texture) are present, the opposed or mating surface textures may have corresponding or complementary profiles (e.g., offset along the axial axis 44 to overlap and/or to interlock with one tooth being received between adjacent teeth). Furthermore, it should be appreciated that the surface texture may be provided on the radially-inner surface of the housing, while the radially-outer annular surface of the hanger is devoid of the surface texture (e.g., may be smooth, such as without radially-outwardly extending teeth and/or relatively smooth compared to the radially-inner annular surface of the housing 52 that is configured to engage and/or seal against the radially-outer annular surface of the hanger).

It should also be appreciated that the various surface textures may be machined onto the respective surfaces. In some embodiments, the surface textures may be hardened to facilitate engagement with other surfaces. For example, the tubing hanger surface texture may have a first hardness (e.g., via material selection and/or a treatment process, such as nitriding and/or heat treatment) that is greater than a second hardness of the radially-inner annular surface 56 of the housing 52 to facilitate the engagement with the housing 52. Indeed, opposed surface textures may have different hardness levels and/or opposed surface textures and surfaces may have different hardness levels to facilitate the engagement and/or the seal.

In some embodiments, the wellhead 12, the hanger system 50, and the seal system 54 may be devoid of a shoulder that supports and facilitates sealing between the wellhead 12 and the hanger system 50. For example, there may not be a separate radially-inwardly extending shoulder along the housing 52 of the wellhead 12 that contacts, supports, and/or blocks movement of (e.g., along the axial axis 44 toward the well) the tubing hanger 34 and/or the casing hanger 36. However, there may be the separate radially-inwardly extending shoulder along the housing 52 of the wellhead 12 that acts as a mechanical stop to contact, support, and/or block the movement of the tubing hanger 34 and/or the casing hanger 36.

The hanger system 50 may include various components that operate as an alignment system (e.g., axial alignment system) to facilitate setting the tubing hanger 34 and/or the casing hanger 36 within the housing 52. The hanger system 50 may also include various components that operate as a seal monitoring system to assess a degree of engagement and/or an effectiveness (e.g., adequacy) of the seal between the tubing hanger 34 and the housing 52 and/or the seal between the casing hanger 36 and the housing 52. In particular, the hanger system 50 may include one or more sensors 80 (e.g., alignment sensors; digital sensors), one or more sensors 90 (e.g., seal sensors; digital sensors), and/or a controller 82 (e.g., electronic controller) that includes a processor 84 and a memory device 86.

With respect to the alignment system, the one or more sensors 80 are configured to generate signals (e.g., data) that are indicative of a position of the tubing hanger 34 and/or a position of the casing hanger 36 within the housing 52. The one or more sensors 80 are communicatively coupled (e.g., wirelessly or wired) to the controller 82 (e.g., electronic controller) and provide the signals to the controller 82. The controller 82 processes the signals to determine the position of the tubing hanger 34 and/or the casing hanger 36 within the housing 52.

The controller 82 may compare the signals to one or more patterns or profiles (e.g., generated based on empirical or modeled data; stored in the memory device 86 or other storage device) to determine the position of the tubing hanger 34 and/or the casing hanger 36 within the housing 52. For example, the controller 82 may select a particular pattern or profile for the tubing hanger 34 (e.g., based on features, such as a size and/or the tubing hanger surface texture, of the tubing hanger 34), and the controller 82 may compare the signals to the particular pattern or profile. Then, after or upon identifying that the signals correspond to (e.g., match, such as substantially match) the particular pattern or profile, the controller 82 may determine that the position of the tubing hanger 34 corresponds to a final position (e.g., an aligned position) in which the tubing hanger 34 is aligned with the first clamp of the compression system 60 and/or an appropriate portion of the housing 52 (e.g., with the first housing surface texture, when present). Furthermore, in response to determining that the tubing hanger 34 is in the final position, the controller 82 may provide one or more outputs. For example, the one or more outputs may include displayed information on a display screen for visualization by an operator, control signals to control the tool that moves the tubing hanger 34 through the housing 52, and/or control signals to control the first clamp of the compression system 60.

In some embodiments, the one or more sensors 80 may include one or more acoustic sensors (e.g., piezoelectric sensors; vibration sensors) that are configured to monitor vibrations (e.g., acoustic waves) generated by the tubing hanger 34 and/or the casing hanger 36 moving through the housing 52. In particular, the one or more sensors 80 may detect vibrations generated due to (e.g., induced by) contact between surfaces and/or structures as the tubing hanger 34 and/or the casing hanger 36 move through the housing 52. For example, the tubing hanger surface texture of the radially-outer annular surface 58 of the tubing hanger 34 may slide against a surface and/or structure of the housing 52 (e.g., the radially-inner annular surface 56 of the housing 52 with or without the first housing surface texture; some other surface or structure, such as a radially-inwardly extending ledge or lip) prior to and/or upon reaching the final position, thereby generating the vibrations that are detected by the one or more sensors 80. When the shoulder(s) is present in the housing 52 (e.g., to act as the mechanical stop), the one or more sensors 80 may detect vibrations generated due to contact between the shoulder(s) and the tubing hanger 34 and/or the casing hanger 36.

In any case, the one or more sensors 80 provide the signals indicative of the vibrations to the controller 82, which processes the signals to determine the position of the tubing hanger 34 within the housing 52. The controller 82 may access the one or more patterns or profiles that represent expected vibrations (e.g., over time) as the tubing hanger 34 moves toward the final position and/or reaches the final position. When multiple patterns or profiles are available, the controller 82 may select the particular pattern or profile that is suitable for the tubing hanger 34 and/or the wellhead 12.

For example, it may be expected that the tubing hanger surface texture generates one type of vibration (e.g., with first characteristics, such as amplitude and/or frequency) as the tubing hanger surface texture moves through a first portion of the housing 52 and then generates another type of vibration (e.g., with second characteristics, such as amplitude and/or frequency) as the tubing hanger surface texture moves through a second portion of the housing 52, such as across the first housing surface texture on the radially-inner annular surface 56 of the housing 52. Thus, upon identifying the vibrations correspond to the one or more patterns or profiles, the controller 82 may determine that the tubing hanger 34 has reached the final position or derive a time and/or a distance to the final position (e.g., based on a known distance between the surface and/or structure that induced certain vibrations and/or a known rate of movement of the tubing hanger 34 through the housing 52). The controller 82 may determine the one or more patterns or profiles based on empirical data and/or model data. The controller 82 may update the one or more patterns or profiles over time based on newly acquired information (e.g., respective signals generated by one or more sensors during hanger running operations at multiple different well sites).

Additionally, in some embodiments, the housing 52, the tubing hanger 34, the casing hanger 36, and/or the surface textures may be configured not to contact other surfaces and/or structures as the tubing hanger 34 and/or the casing hanger 36 move through the housing 52, or any contact may not be used to facilitate alignment. The one or more sensors 80 may be one or more acoustic sensors that are configured to emit and to detect acoustic waves (e.g., reflected from the tubing hanger 34 and/or the casing hanger 36) that indicate a presence of and the position of the tubing hanger 34 and/or the casing hanger 36. The one or more sensors 80 may be any of a variety of other types of sensors, such as optical sensors that are configured to emit and to detect light (e.g., reflected from the tubing hanger 34 and/or the casing hanger 36) that indicate the presence of and the position of the tubing hanger 34 and/or the casing hanger 36. The one or more sensors 80 may also be configured to emit and to detect the acoustic waves or the light to more particularly detect the presence of and the position of the surface texture (e.g., due to certain patterns in the reflected acoustic waves or the light from the surface texture).

In any case, the one or more sensors 80 may generate the signals indicative of the acoustic waves or the light, and the controller 82 may process the signals to determine that the tubing hanger 34 and/or the casing hanger 36 is in its final position. For example, the controller 82 may access one or more patterns or profiles that represent expected signals (e.g., over time; acoustic waves or the light) as the tubing hanger 34 moves toward the final position and/or reaches the final position. When multiple patterns or profiles are available, the controller 82 may select the particular pattern or profile that is suitable for the tubing hanger 34 and/or the wellhead 12.

For example, it may be expected that the acoustic waves or the light may have certain features (e.g., amplitude and/or frequency) when not reflected from the tubing hanger surface texture, and other features when reflected from the tubing hanger surface texture. Thus, upon identifying the other features in the acoustic waves or the light received at the one or more sensors 80 and/or determining that the acoustic waves or the light received at the one or more sensors 80 correspond to the particular pattern or profile, the controller 82 may determine that the tubing hanger 34 has reached the final position or derive a time and/or a distance to the final position (e.g., based on known respective positions and/or a known rate of movement of the tubing hanger 34 through the housing 52).

It should be appreciated that the controller 82 may determine the one or more patterns or profiles based on empirical data and/or model data. The controller 82 may update the one or more patterns or profiles over time based on newly acquired information (e.g., respective signals generated by one or more sensors during hanger running operations at multiple different well sites). It should also be appreciated that the one or more sensors 80 may include one or more mechanical sensors, such as contact sensors, that are configured to provide outputs (e.g., signals) that are indicative of the position of the tubing hanger 34 and/or the casing hanger 36 within the housing 52. For example, contact with the contact sensors indicates that the tubing hanger 34 and/or the casing hanger 36 is in the final position within the housing 52.

As noted herein, the hanger system 50 may include various components that operate as the seal monitoring system to assess the degree of engagement and/or the effectiveness of the seal formed between the tubing hanger 34 and the housing 52 and/or the seal formed between the casing hanger 36 and the housing 52. As shown, the hanger system 50 may include the one or more sensors 90 that are configured to generate the signals indicative of deformation of the housing 52 and/or components of the compression system 60. The one or more sensors 90 may include one or more strain sensors (e.g., strain gauges, strain meters, piezoelectric sensors) that are mounted on the housing 52 and/or the components of the compression system 60.

The one or more sensors 90 may generate the signals indicative of the deformation, and the controller 82 may process the signals to determine that the housing 52 and/or the compression system 60 has reached a target deformation. For example, the controller 82 may access the target deformation that represents an expected deformation during an appropriate degree of engagement and/or effective sealing. When multiple target deformations are available, the controller 82 may select a particular target deformation that is suitable for the tubing hanger 34 and/or the wellhead 12. Additionally, the target deformation may include a pattern or profile of deformation, wherein the pattern or profile represents an expected deformation that is expected to occur over time as the compression system 60 drives the housing 52 toward the tubing hanger 34. In any case, upon determining that the deformation measured by the one or more sensors 90 corresponds to the target deformation, the controller 82 may determine that there is effective engagement and/or sealing between the tubing hanger 34 and the housing 52. It should be appreciated that the controller 82 may determine the target deformation based on empirical data and/or model data. The controller 82 may update the target deformation based on newly acquired information (e.g., respective signals generated by one or more sensors during hanger running operations at multiple different well sites).

In some embodiments, the one or more sensors 80 may be acoustic sensors, and the controller 82 may process the signals indicative of the vibrations to assess the degree of engagement and/or the effectiveness of the seal formed between the tubing hanger 34 and the housing 52. For example, the controller 82 may access the one or more patterns or profiles that represent expected vibrations (e.g., over time) as the degree of engagement increases to be adequate and/or the effectiveness of the seal increases to be adequate. When multiple patterns or profiles are available, the controller 82 may select the particular pattern or profile that is suitable for the tubing hanger 34 and/or the wellhead 12.

It may be expected that the tubing hanger surface texture generates one type of vibration (e.g., with first characteristics, such as amplitude and/or frequency) as the tubing hanger surface texture initially engages the housing 52 and then generates another type of vibration (e.g., with second characteristics, such as amplitude and/or frequency) as the tubing hanger surface texture fully engages and seals against the housing 52. Thus, upon identifying the vibrations correspond to a suitable pattern or profile, the controller 82 may identify the degree of engagement and/or effective sealing.

It should be appreciated that the controller 82 may determine the one or more patterns or profiles based on empirical data and/or model data. The controller 82 may update the one or more patterns or profiles over time based on newly acquired information (e.g., respective signals generated by one or more sensors during hanger running operations at multiple different well sites).

Thus, a single sensor and/or a group of sensors of a single/same sensor type, such as acoustic sensors, may monitor both position and seal efficacy. However, any of the sensors disclosed herein may be used in any suitable combination (e.g., type and/or position). Thus, one or more of the sensors 80 (which may be acoustic sensors, optical sensors, mechanical sensors, or any other suitable type of sensor configured to detect at least a presence of a position) and/or one or more of the sensors 90 (which may be strain gauges, acoustic sensors, or any other suitable type of sensor configured to detect at least a grip force/degree of engagement/load capacity) monitor the position of the tubing hanger 34 and/or the seal formed between the tubing hanger 34 and the housing 52.

The controller 82 may provide one or more outputs based on the signals from the one or more sensors 80 and/or the one or more sensors 90. For example, in response to determining that the tubing hanger 34 is not in the final position, the controller 82 may provide control signals to control the tool, and/or otherwise enable movement of the tool, with the tubing hanger 34 through the housing 52 (e.g., as part of a feedback loop). In response to determining that the tubing hanger 34 is in the final position, the controller 82 may provide control signals to control the tool, and/or otherwise block movement of the tool, with the tubing hanger 34 through the housing 52. In this way, the one or more sensors 80 may be used to assess the position of the tubing hanger 34 and/or the seal formed between the tubing hanger 34 and the housing 52.

In response to determining that the deformation does not correspond to the target deformation, the controller 82 may provide control signals to control the compression system 60, and/or otherwise enable further adjustment of the compression system 60 (e.g., as part of a feedback loop). In response to determining that the deformation corresponds to the target deformation, the controller 82 may provide control signals to control the compression system 60, and/or otherwise block further adjustment of the compression system 60, so that the tubing hanger 34, the housing 52, and/or the components of the compressions system 60 are not deformed more than desired to provide the appropriate degree of engagement and/or effective sealing. Advantageously, limiting the deformation in this way may avoid exceeding a yield point of the tubing hanger 34 and/or facilitate subsequent operations to add one or more hangers (e.g., without having to loosen the compression system 60, allow for a first grip with the tubing hanger 34 and then to tighten to a second grip upon addition of another tubing hanger). Additionally or alternatively, the controller 82 may provide control signals to control the tool, and/or otherwise separate the tool from the tubing hanger 34 to withdraw the tool from the housing 52. The one or more outputs may also include providing information on a display screen for visualization by an operator, wherein the information includes an indication of whether the tubing hanger 34 has reached the final position, an indication of whether the effective sealing has been achieved, or the like. It should be appreciated that in some cases, the compression system 60 may be at a limit position (e.g., at a tightest position; unable to apply more grip) and the deformation may not correspond to (e.g., be less than) the target deformation. In such cases, the one or more outputs may include an alert to inspect the hanger system 50 (e.g., via the display screen) and/or control signals to release the compression system 60 to facilitate inspection/maintenance. Certain examples herein reference the tubing hanger 34 to facilitate discussion; however, it should be appreciated that features and operations described with reference to the tubing hanger 34 may also be applied to determine the position of the casing hanger 36 and/or the effectiveness of the seal at the casing hanger 36.

The controller 82 may be a dedicated controller for the hanger system 50, and/or the controller 82 may be part of or include a distributed controller with one or more controllers in communication with one another to carry out the various techniques disclosed herein. The processor 84 may include one or more processors configured to execute software, such as software for processing signals and/or controlling the components of the hanger system 50. The memory device 86 may include one or more memory devices (e.g., a volatile memory, such as random access memory [RAM], and/or a nonvolatile memory, such as read-only memory [ROM]) that may store a variety of information and may be used for various purposes. For example, the memory device 86 may store processor-executable instructions (e.g., firmware or software) for the processor 84 to execute, such as instructions for processing signals from the one or more sensors 80,90 and/or controlling the components of the hanger system 50 (e.g., the compression system 60). It should be appreciated that the controller 82 may include various other components, such as a communication device that is capable of communicating data or other information to various other devices (e.g., a remote computing system) and/or a display screen that is capable of displaying a status of the hanger system 50 (e.g., alignment; formation of the seals). The controller 82 may provide various levels of automation to the hanger system 50 (e.g., some or all of the steps to place the hangers in the housing 52 may be carried out in an automated sequence).

Also, as shown, the hanger system 50 may include or be configured for use with other components. For example, a cementing system 110 may include a cementing nipple 112 that couples to the housing 52, a flexible hose 114 (e.g., flexible line), and a coupling 116 (e.g., quick-connect coupling) that joins the housing 52 to the flexible hose 114. In particular, the cementing nipple 112 may engage and extend through an opening 118 in the housing 52. In this way, a cement may be provided through the flexible hose 114 and through the housing 52 to cement the casing that is supported by the casing hanger 36. The flexible hose may be compliant along its length (e.g., not a rigid pipe; polymer hose and not a metal/metal alloy pipe).

Figure 3:
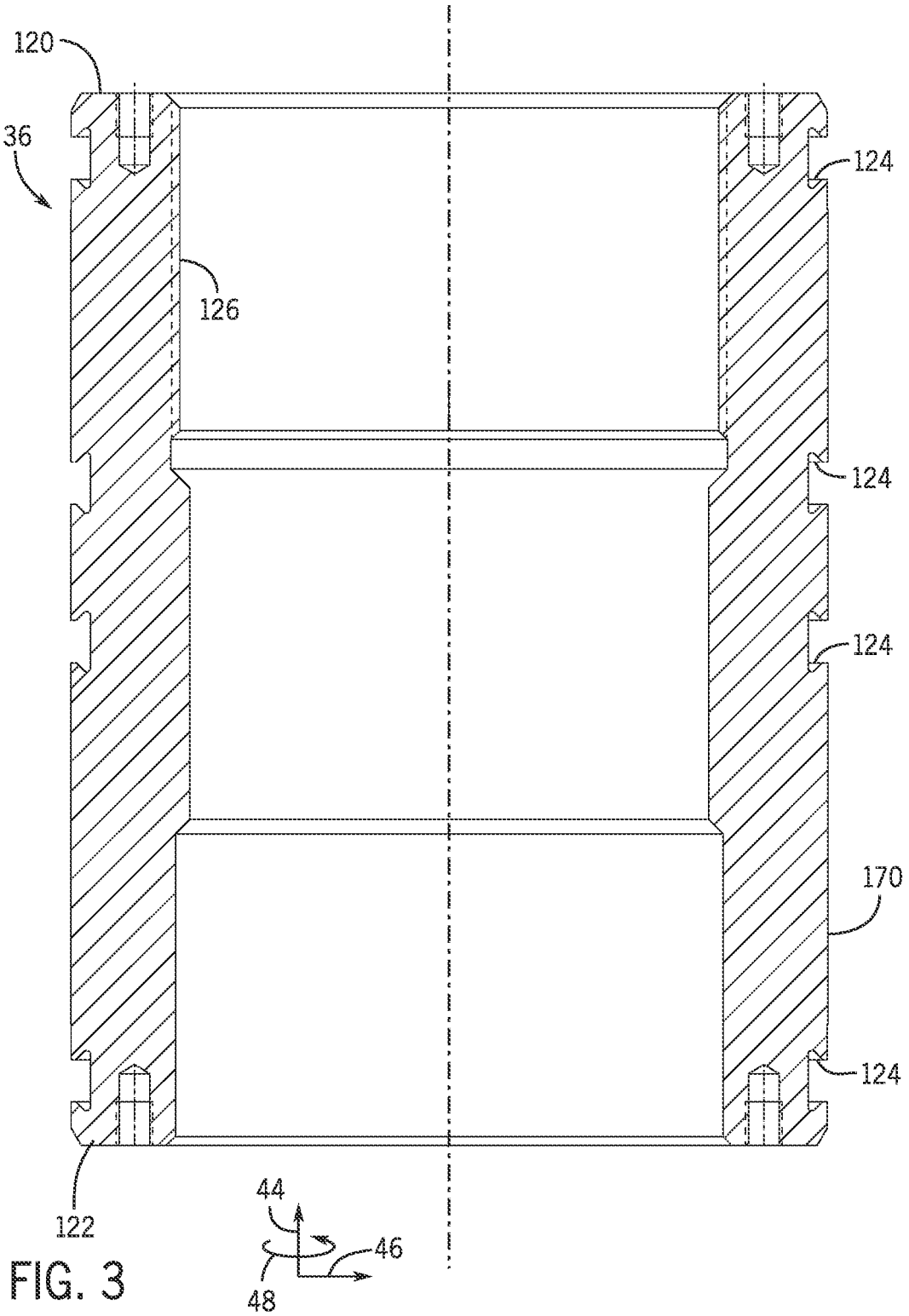
FIG. 3 is a cross-sectional side view of a portion of a hanger that may be utilized within the hanger system of FIG. 2, in accordance with an embodiment of the present disclosure.

FIG. 3 is a cross-sectional side view of a portion of the casing hanger 36 that may be utilized within the hanger system 50 of FIG. 2, in accordance with an embodiment of the present disclosure. However, it should be appreciated that the tubing hanger 34 may have the same or similar features. As shown, the casing hanger 36 extends from a first end 120 (e.g., proximal end) to a second end 122 (e.g., distal end). Seal grooves 124 are formed in the radially-outer annular surface 170 and are configured to support the one or more non-metal supplemental seals (e.g., annular elastomer seals, such as o-ring seals). Additionally, the casing hanger surface texture may be provided on the radially-outer annular surface 170, such as in one or more sections located between the seal grooves 124 along the axial axis 44. In some embodiments, a threaded surface 126 (e.g., radially-inner annular surface) is provided to enable the casing hanger 36 to threadably couple to the tool during running operations.

Figure 4:
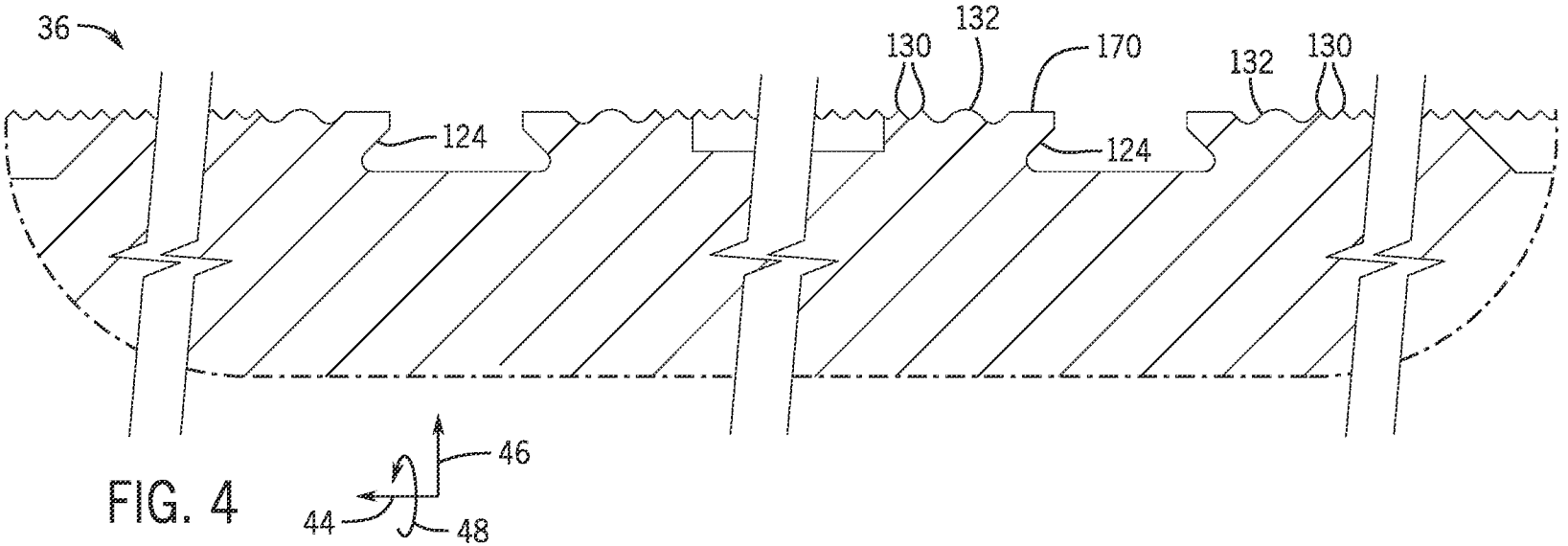
FIG. 4 is a cross-sectional side view of another portion of the hanger of FIG. 3, in accordance with an embodiment of the present disclosure.

FIG. 4 is a cross-sectional side view of a portion of the casing hanger 36 of FIG. 3, in accordance with an embodiment of the present disclosure. As noted herein, it should be appreciated that the tubing hanger 34 may have the same or similar features. As shown, the casing hanger surface texture is provided on the radially-outer annular surface 170, such as in the one or more sections located between the seal grooves 124 along the axial axis 44. The casing hanger surface texture includes multiple teeth 130 that protrude from the radially-outer annular surface 170.

In some embodiments, the multiple teeth 130 may include pointed edges (e.g., annular edges) that extend circumferentially about the radially-outer annular surface 170 and are spaced apart along the axial axis 44 (e.g., by a distance/spacing between adjacent teeth). The multiple teeth 130 are not configured to form a threaded interface (e.g., the multiple teeth 130 are not helical or angled with respect to the axial axis 44; each of the multiple teeth 130 extends along the circumferential axis 48; when engaged with a complementary annular structure, such as opposed teeth in the housing 52, the multiple teeth block movement of the casing hanger 36 along the axial axis 44 rather than driving movement of the casing hanger 36 along the axial axis 44 relative to the complementary annular structure as would occur with a threaded interface). As shown, the multiple teeth 130 may form a series of valleys and troughs or a wave-like shape in the cross-sectional side view. In some embodiments, curved protrusions 132 are provided on opposite axial sides of the seal grooves 124 to provide structural support for the seal grooves 124 and/or transition to the multiple teeth 130.

Figure 5:
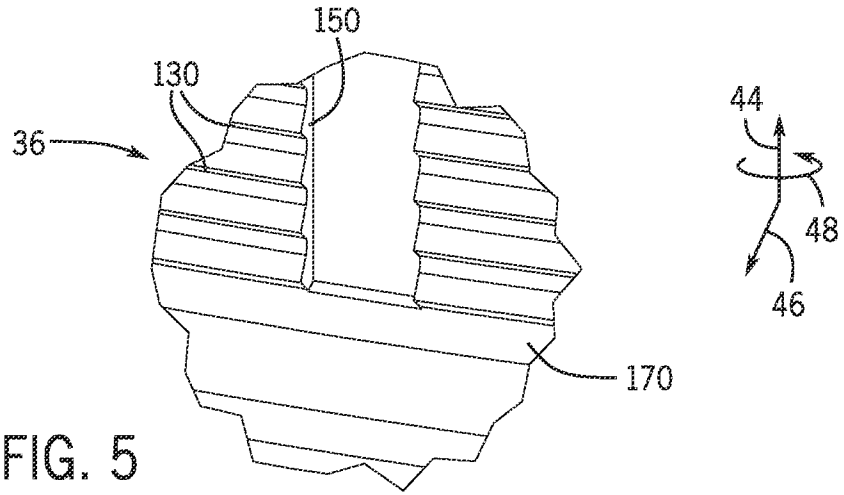
FIG. 5 is a perspective side view of another portion of the hanger of FIG. 3, wherein a slot is positioned between adjacent sections that have a surface texture, in accordance with an embodiment of the present disclosure.

FIG. 5 is a perspective side view of a portion of the casing hanger 36 of FIG. 3, wherein a slot 150 is positioned between adjacent sections of the multiple teeth 130 that form the casing hanger surface texture, in accordance with an embodiment of the present disclosure. The slot 150 extends along the axial axis 44 and about a portion of a circumference of the radially-outer annular surface 170 of the casing hanger 36. Furthermore, multiple slots 150 may be spaced apart about the circumference of the radially-outer annular surface 170 of the casing hanger 36. Notably, the slot(s) is an optional feature, and the casing hanger 36 may be devoid of the slot(s) and/or have a continuous, annular construction.

Figure 6:
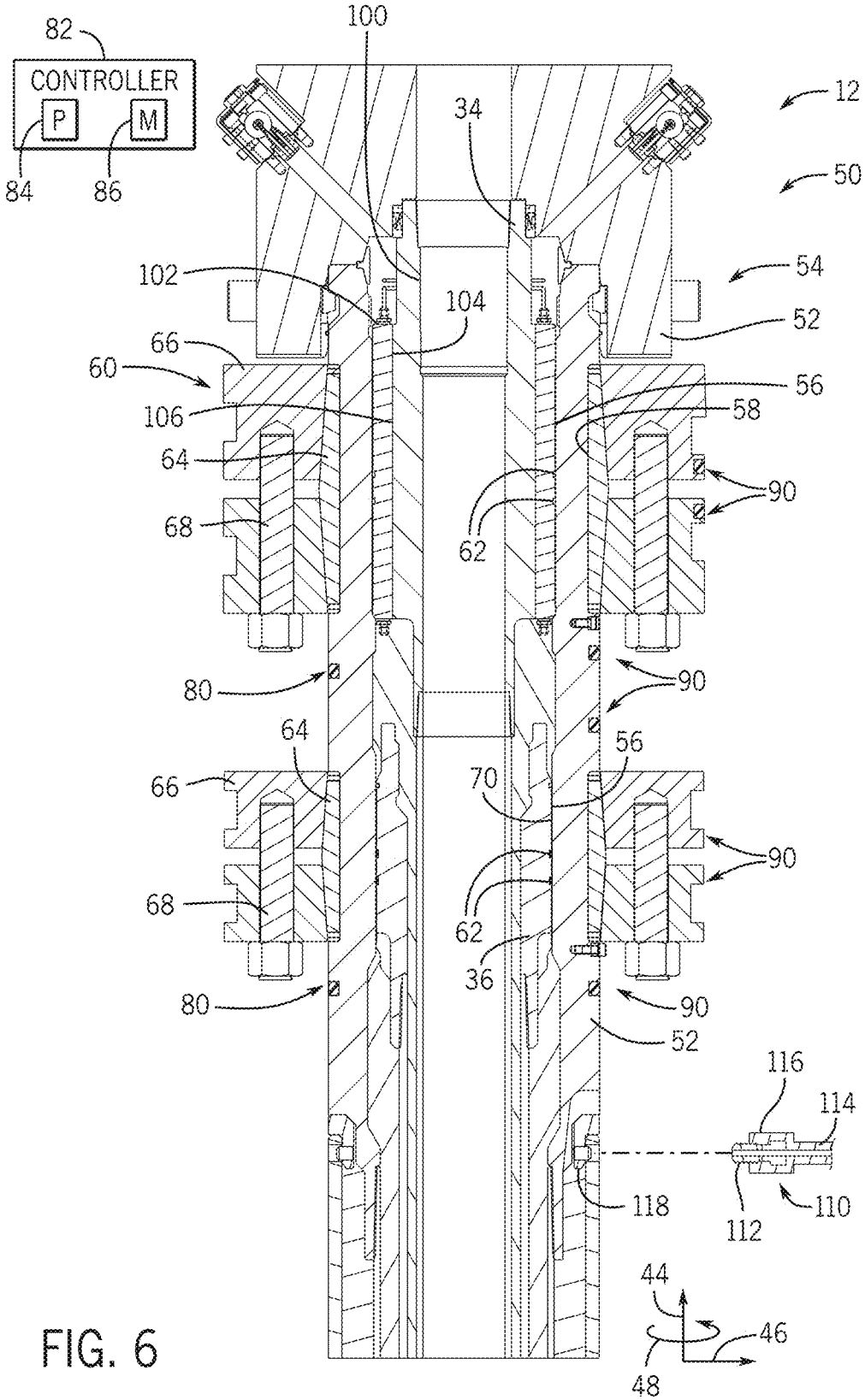
FIG. 6 is a cross-sectional side view of a hanger system that may be utilized within a wellhead of the mineral extraction system of FIG. 1, wherein the hanger system includes a two-part tubing hanger, in accordance with an embodiment of the present disclosure.

FIG. 6 is a cross-sectional side view of the hanger system 50 that may be utilized within the wellhead 12 of the mineral extraction system 10 of FIG. 1, wherein the hanger system 50 includes a two-part tubing hanger 34, in accordance with an embodiment of the present disclosure. Other components in FIG. 6 may be the same or similar to the components described with reference to FIG. 2.

In some embodiments, it may be beneficial to have the two-part tubing hanger 34 with an inner annular ring 100 and an outer annular ring 102. The inner annular ring 100 may be formed from a first material, and the outer annular ring 102 may be formed from a second material that is different from the first material (e.g., less expensive than the first material). Thus, the two-part tubing hanger 34 may provide certain cost savings and/or other advantages. In some embodiments, the outer annular ring 102 may include axially-extending control line ports (from an upper end surface to a lower end surface to allow control lines to extend through the outer annular ring 102) and/or radially-extending test ports to facilitate various tests (e.g., pressure tests). In some embodiments, a retainer ring may support the inner annular ring 100 and the outer annular ring 102 so that the two structures move together (e.g., the retainer ring extends radially-outwardly from the inner annular ring 100, and the outer annular ring 102 contacts and rests on the retainer ring).

An inner annular ring surface texture may be provided on a radially-outer annular surface 104 of the inner annular ring 100 and an inner tubing hanger surface texture may be provided on a radially-inner annular surface 106 of the outer annular ring 102. In operation, the inner annular ring 100 and the outer annular ring 102 may be lowered together into the housing 52 (e.g., via the tool). Then, once in alignment with the first housing surface texture (e.g., as detected by the one or more sensors 80), the first clamp may be actuated to create the seal formed between the tubing hanger 34 and the housing 52 (e.g., between the tubing hanger surface texture and the housing 52) and also to create an internal seal between the inner annular ring surface texture and the inner tubing hanger surface texture (e.g., between the inner annular ring 100 and the outer annular ring 102 of the tubing hanger 34). The internal seal may be a metal-to-metal seal. The two-part hanger may include wedge-shaped structures (e.g., the inner annular ring 100 and the outer annular ring 102 may be wedge-shaped with oppositely-inclined tapered surfaces that contact one another while the internal seal is formed and/or there may be additional wedge-shaped structures that form a hanger assembly).

Notably, the two-part tubing hanger is an optional configuration, and the tubing hanger 34 may instead be one-piece or at least have a one-piece construction between the radially-outer annular surface and a radially-inner annular surface along a length of the tubing hanger 34 that is axially aligned with the tubing hanger surface texture (e.g., the tubing hanger 34 is a solid, one-piece at least along the length of the tubing hanger 34 that is radially-inward of the tubing hanger surface texture), as shown in FIG. 2. Also, as shown, the hanger system 50 may include the cementing system 110 with the cementing nipple 112, the flexible hose 114, and the coupling 116. In particular, the cementing nipple 112 may engage and extend through the opening 118 in the housing 52 to provide cement.

Figure 7:
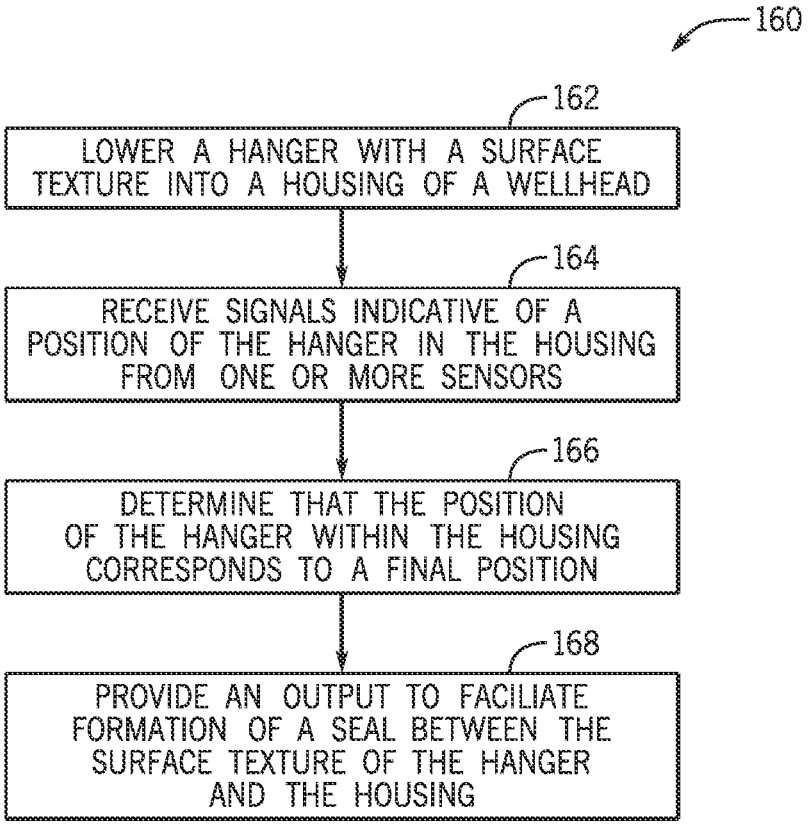
FIG. 7 is a flow diagram of a method of installing a hanger in a wellhead of a mineral extraction system, in accordance with an embodiment of the present disclosure.

FIG. 7 is a flow diagram of a method 160 of installing a hanger, such as the tubing hanger 34 and/or the casing hanger 36, in a wellhead of a mineral extraction system, in accordance with an embodiment of the present disclosure. The method 160 may be performed as an automated procedure by a system, such as by the controller 82 shown in FIG. 2. Although the flow diagram illustrates the steps in a certain sequence, it should be understood that the steps may be performed in any suitable order and certain steps may be carried out simultaneously, where appropriate. Further, certain steps shown in FIG. 7 may be omitted and additional steps may be added.

In step 162, the method 160 may begin by lowering the hanger into the housing of the wellhead. For example, the controller may provide control signals to a tool actuator that adjusts a tool that supports the hanger and lowers the hanger into the housing of the wellhead. The hanger may have a hanger surface texture that is configured to facilitate engagement and sealing with the housing of the wellhead.

In step 164, the controller may receive signals indicate of a position of the hanger within the housing from one or more sensors. The one or more sensors may be positioned at any suitable position within the housing to detect the position of the hanger within the housing, and the one or more sensors may then provide the signals to the controller. As noted herein, the one or more sensors may include any suitable position sensor, such as an acoustic sensor that detects vibrations induced by movement of the hanger through the housing, an acoustic sensor that emits and detects reflected acoustic waves, an optical sensor that emits and detects reflected light, and/or a contact sensor that detects contact with the hanger. In some embodiments, the hanger surface texture may facilitate monitoring the position of the hanger within the housing.

In step 166, the controller may process the signals to determine that the position of the hanger within the housing is a final position (e.g., an alignment position). For example, the controller may compare the signals to one or more patterns or profiles to determine that the hanger has reached the final position. In the final position, a portion of the hanger, such as the hanger surface texture on the hanger, is aligned with a first clamp of a compression system and/or with a portion of the housing, such as a housing surface texture on the housing.

In step 168, the controller may initiate an output in response to determining that the hanger has reached the final position. The output is configured to facilitate formation of a seal (e.g., an annular seal) between the housing and the hanger, wherein the seal may be formed at least in part via the surface texture(s) on the hanger and/or on the housing. For example, the output may include a control signal to the tool actuator to stop lowering the hanger through the housing. Additionally or alternatively, the output may include a control signal to actuate the first clamp of the compression system to drive the housing toward the hanger and/or an alert (e.g., via a display screen) that is visible to an operator to enable the operator to carry out steps to control the tool actuator and/or the compression system.

As discussed herein, the controller may also receive data indicative of an effectiveness of the seal formed between the housing and the hanger. For example, one or more sensors, such as strain gauges, may be positioned on the housing and/or on the compression system. In such cases, the signals may be indicative of the strain or the deformation in the housing and/or the compression system, and the controller may correlate the deformation to the effectiveness of the seal (e.g., based on whether the deformation corresponds to a target deformation). Then, the controller may initiate an output based on the effectiveness of the seal. For example, the output may include a control signal to the tool actuator to separate from the hanger and to withdraw from the housing, a control signal to the compression system to block further compression of the housing toward the hanger, and/or an alert to the operator to enable the operator to carry out steps to control the tool actuator and/or the compression system.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the invention as defined by the following appended claims. For example, while the illustrated embodiments show the tubing hanger 34 and the casing hanger 36, it should be understood that the systems and methods may be adapted to for use with any of a variety of other annular structures.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a hanger comprising a radially-outer surface with a hanger surface texture;

a sensor configured to detect vibrations induced by the hanger surface texture as the hanger moves through a housing of a wellhead;

a controller configured to receive signals indicative of the vibrations from the sensor and to process the signals to determine a position of the hanger within the housing of the wellhead;

a first clamp coupled to the wellhead and configured to drive the housing of the wellhead radially-inwardly to cause engagement between the hanger surface texture and the housing of the wellhead, wherein the engagement comprises an annular seal between the hanger surface texture and the housing of the wellhead.

2. The system of claim 1, wherein the controller is configured to process the signals to identify alignment between the hanger surface texture and a portion of a radially-inner surface of the housing of the wellhead.

3. The system of claim 2, wherein the controller is configured to compare the signals to a signature to identify the alignment between the hanger surface texture and the portion of the radially-inner surface of the housing of the wellhead.

4. The system of claim 2, wherein the controller is configured to output a control signal to block further movement of the hanger through the housing of the wellhead in response to identifying the alignment between the hanger surface texture and the portion of the radially-inner surface of the housing of the wellhead.

5. The system of claim 2, comprising the housing of the wellhead, wherein the portion of the radially-inner surface of the housing of the wellhead comprises a housing surface texture that is complementary to the hanger surface texture.

6. The system of claim 1, comprising:

an additional sensor configured to detect deformation in the housing of the wellhead upon the engagement between the hanger surface texture and the housing of the wellhead, wherein the controller is configured to receive additional signals indicative of the deformation from the additional sensor and to process the additional signals to determine whether the engagement is adequate.

7. The system of claim 6, wherein the controller is configured to compare the deformation to a target deformation to determine whether the engagement is adequate and to output a control signal to stop further tightening of the first clamp in response to the engagement being adequate.

8. The system of claim 1, wherein the hanger is a tubing hanger or a casing hanger.

9. A system, comprising:

a hanger configured to move in an axial direction within a housing of a wellhead, wherein the hanger comprises a radially-outer surface with a hanger surface texture;

a sensor configured to generate signals indicative of axial alignment of the hanger surface texture with a clamp coupled to the housing of the wellhead; and a controller configured to receive the signals, analyze the signals to identify the axial alignment, and provide an output in response to identifying the axial alignment, wherein the output comprises a control signal to actuate the clamp to drive the housing of the wellhead radially-inwardly toward the hanger.

10. The system of claim 9, wherein the sensor comprises an acoustic sensor that is configured to generate the signals based on detection of vibrations induced by the hanger surface texture as the hanger moves through the housing of the wellhead.

11. The system of claim 9, wherein the controller is configured to compare the signals to a signature to identify the axial alignment.

12. The system of claim 9, comprising the housing of the wellhead, wherein a portion of a radially-inner surface of the housing of the wellhead that faces the hanger surface texture during the axial alignment comprises a housing surface texture that is complementary to the hanger surface texture.

13. A method, comprising:

running, with a hanger running tool, a hanger into a housing of a wellhead, wherein the hanger comprises a radially-outer surface with a hanger surface texture;

detecting, with a sensor, vibrations induced by contact between the hanger surface texture and the housing of the wellhead as the hanger moves through the housing of the wellhead;

processing, at a controller, signals generated by the sensor to determine a position of the hanger within the housing of the wellhead;

comparing, with the controller, the signals to a signature to identify alignment between the hanger surface texture and a portion of a radially-inner surface of the housing of the wellhead; and providing, with the controller, control signals to a clamp coupled to the wellhead to drive the housing of the wellhead radially-inwardly to cause engagement between the hanger surface texture and the portion of the radially-inner surface of the housing of the wellhead.

14. The method of claim 13, comprising;

detecting, with the sensor or an additional sensor, deformation in the housing of the wellhead upon the engagement between the hanger surface texture and the housing of the wellhead; and processing, at the controller, additional signals indicative of the deformation in the housing of the wellhead to determine whether the engagement is adequate.

15. The method of claim 13, comprising flowing a cement through a flexible hose and into the housing of the wellhead to cement casing suspended from the hanger.

* * * * *